US008261580B2

(12) United States Patent
Kim et al.

(10) Patent No.: US 8,261,580 B2
(45) **Date of Patent: *Sep. 11, 2012**

(54) APPARATUS TO REINFORCE A DRUM WASHING MACHINE

(75) Inventors: Jae Myong Kim, Seoul (KR); Koan Seog Namkung, Hwasung-Si (KR); Koang Hun Ryu, Hwasung-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/662,912

(22) Filed: May 11, 2010

(65) Prior Publication Data

US 2010/0275658 A1 Nov. 4, 2010

Related U.S. Application Data

(63) Continuation of application No. 10/895,308, filed on Jul. 21, 2004, now Pat. No. 7,805,965.

(30) Foreign Application Priority Data

Nov. 10, 2003 (KR) ..... 10-2003-79254

(51) Int. Cl.
*D06F 37/26* (2006.01)

(52) U.S. Cl. ..... 68/3 R

(58) Field of Classification Search ..... 68/142, 68/3 R, 139; 312/228, 228.1
See application file for complete search history.

(56) References Cited

U.S. PATENT DOCUMENTS

| | | | | |
|---|---|---|---|---|
| 3,377,756 | A | 4/1968 | Polhamus | |
| 3,477,259 | A | 11/1969 | Barrett Colin et al. | |
| 4,692,987 | A * | 9/1987 | Cuthbert et al. | 29/455.1 |
| 5,588,313 | A * | 12/1996 | Hildebrand | 68/17 R |
| 5,881,576 | A | 3/1999 | Davies, Jr. | |
| 6,237,544 | B1 | 5/2001 | Croxford et al. | |
| 7,685,847 | B2 * | 3/2010 | Lee et al. | 68/3 R |
| 2003/0056300 | A1 | 3/2003 | Ruhl et al. | |
| 2003/0172690 | A1 | 9/2003 | Kim et al. | |
| 2004/0007371 | A1 | 1/2004 | Chang | |
| 2004/0020073 | A1 * | 2/2004 | Lee et al. | 34/602 |

FOREIGN PATENT DOCUMENTS

EP 0695825 2/1996

(Continued)

OTHER PUBLICATIONS machine translation of JP2001-212396 (Aug. 2001).*

(Continued)

*Primary Examiner* — Joseph L Perrin
(74) *Attorney, Agent, or Firm* — Staas & Halsey LLP

(57) ABSTRACT

A drum washing machine allows a plurality of electric wires to be easily secured in a cabinet, in addition to reinforcing strength of a top plate. The drum washing machine includes a cabinet having an opening at an upper portion thereof, a top plate to cover the opening, and a reinforcement placed at a predetermined position of the opening to support and reinforce the top plate. A wire holder is provided at a predetermined portion of the reinforcement to hold the electric wires arranged in the cabinet. The drum washing machine is provided with the reinforcement, which reinforces the strength of the top plate, and allows the electric wires to be easily arranged and held in the cabinet.

21 Claims, 2 Drawing Sheets

FOREIGN PATENT DOCUMENTS

JP 2001-212396 8/2001

OTHER PUBLICATIONS

U.S. Appl. No. 10/895,308, filed Jul. 21, 2004, Jae Myong Kim et al., Samsung Electronics Co., Ltd.

Sam Yong Jang, "Electric Wire Grip Device of Washing Machine," Mar. 5, 2001, Korean Patent Abstract.

U.S. Notice of Allowance mailed May 27, 2010 in related U.S. Appl. No. 10/895,308.

* cited by examiner

APPARATUS TO REINFORCE A DRUM WASHING MACHINE

CROSS-REFERENCE TO RELATED APPLICATIONS

This application is a continuation application of application Ser. No. 10/895,308 filed Jul. 21, 2004 now U.S. Pat. No. 7,805,965, and claims the benefit of Korean Patent Application No. 2003-79254, filed Nov. 10, 2003 in the Korean Intellectual Property Office, the disclosure of which is incorporated herein by reference.

BACKGROUND OF THE INVENTION

1. Field of the Invention

The present invention relates, in general, to drum washing machines and, more particularly, to a drum washing machine which is constructed to reinforce a strength of a top plate mounted to an upper portion of a cabinet, and to allow electric wires to be easily arranged and held in the cabinet.

2. Description of the Related Art

Generally, drum washing machines wash laundry by rotating a rotary tub and thereby causing laundry and wash water to contact each other while tumbling from a top of the rotary tub to a bottom of the rotary tub. The drum washing machine includes a cabinet which is open at an upper portion thereof. A top plate is mounted to the upper portion of the cabinet to close the open upper portion of the cabinet.

A water tub is set in the cabinet to contain the wash water therein. The rotary tub is rotatably set in the water tub. The rotary tub is perforated on a sidewall thereof to have a plurality of perforations allowing the wash water, fed from the water tub, to move into the rotary tub.

A front opening is formed on a predetermined portion of a front wall of the cabinet so that a user puts the laundry into the rotary tub through the front opening. A door is mounted to the front wall of the cabinet to horizontally rotate and to open or close the front opening. A plurality of water supply valves are provided at predetermined positions above the water tub, which is set in the cabinet, to supply the wash water into the water tub. A water level sensor is provided at a predetermined position in the cabinet to detect a level of the wash water contained in the water tub.

Further, a control panel having a plurality of buttons is provided on the front wall of the cabinet above the front opening. The buttons allow a user to control operations of the drum washing machine. The water supply valves and the water level sensor are connected to the control panel via a plurality of electric wires to transceive electric signals with the control panel, so that a proper amount of wash water is fed into the water tub according to an operational mode, such as a washing-mode, a rinsing-mode, and a spin drying mode. The cooperation of the water supply valves, the water level sensor, the control panel, and the electric connections therebetween also maintain a proper level of water in the water tub.

The conventional drum washing machine constructed as described above is operated as follows. First, the laundry is put into the rotary tub, and the buttons of the control panel are manipulated. At this time, the water supply valves of a water supply unit are open to feed the wash water into the water tub. When the rotary tub rotates in such a state, the laundry placed on the bottom of the rotary tub moves upward and falls to the bottom of the rotary tub due to gravity. In this case, the level of the wash water contained in the water tub is detected by the water level sensor, and a signal indicative of the wash water level is output from the water level sensor to the control panel to maintain a predetermined water level.

The door of the drum washing machine is mounted to the predetermined portion of the front wall of the cabinet. This is in contrast to a general type of washing machine in which a door thereof is mounted to a top of a cabinet. As a result, in the case of the drum washing machine, a household appliance, such as a laundry drying machine, may be placed on a top wall of the cabinet. In this case, the top plate mounted to the upper portion of the cabinet may be deformed or broken, due to a weight of the household appliance placed on the top plate and the fact that the conventional drum washing machine has no structure to reinforce strength of the top plate.

The conventional drum washing machine has another problem in that the electric wires may be damaged, or a short circuit may occur by the vibration of the water tub during the rotation of the rotary tub, and the electric wires which connect the water supply valves and the water level sensor to the control panel, come into contact with the water tub.

Therefore, a plurality of wire holders are provided on predetermined positions of an inner surface of the cabinet. Further, a cable tie to secure the electric wires is provided on each of the wire holders.

The conventional drum washing machine has a further problem in that a long time is required to install the wire holders and the cable ties on the inner surface of the cabinet and securing the electric wires becomes difficult, because the plurality of wire holders and cable ties must be installed on several positions of the inner surface of the cabinet to secure the electric wires.

SUMMARY OF THE INVENTION

Accordingly, it is an aspect of the present invention to provide a drum washing machine which is constructed to reinforce strength of a top plate, and to allow a plurality of electric wires arranged in a cabinet to be easily secured.

Additional and/or other aspects and advantages of the invention will be set forth in part in the description which follows and, in part, will be obvious from the description, or may be learned by practice of the invention.

The above and/or other aspects are achieved by a drum washing machine, including a cabinet having an opening at an upper portion thereof, a top plate to cover the opening, and a reinforcement placed at a predetermined position of the opening to support and reinforce the top plate.

An electric wire may be arranged in the cabinet. A wire holder may be provided at a predetermined portion of the reinforcement to hold the electric wire.

The reinforcement may include a support plate mounted to a predetermined portion of the cabinet while extending across the opening, and a side plate extending upward from each of both side edges of the support plate to support a lower surface of the top plate.

Further, the wire holder may comprise a plurality of wire holders.

The reinforcement may include a support plate mounted to a predetermined portion of the cabinet while extending across the opening, and a side plate extending upward from each of both side edges of the support plate to support the top plate. The wire holder may include an insert groove provided at a predetermined portion of each of the side plates of the reinforcement to be open at an upper portion of the insert groove, with the electric wire being held in the insert groove, and a wire stopper provided at an edge of the insert groove to hold the electric wire in the insert groove.

The wire stopper may be provided at an edge of an inlet of the insert groove to be integrated with an associated side plate, so that a width of the inlet of the insert groove is less than a width of a remaining part of the insert groove.

A drain hole may be provided on a predetermined portion of the support plate.

The support plate may be provided to couple a front wall to a rear wall of the cabinet.

The wire stopper may be provided so that the width of the inlet of the insert groove is larger than a thickness of the electric wire.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
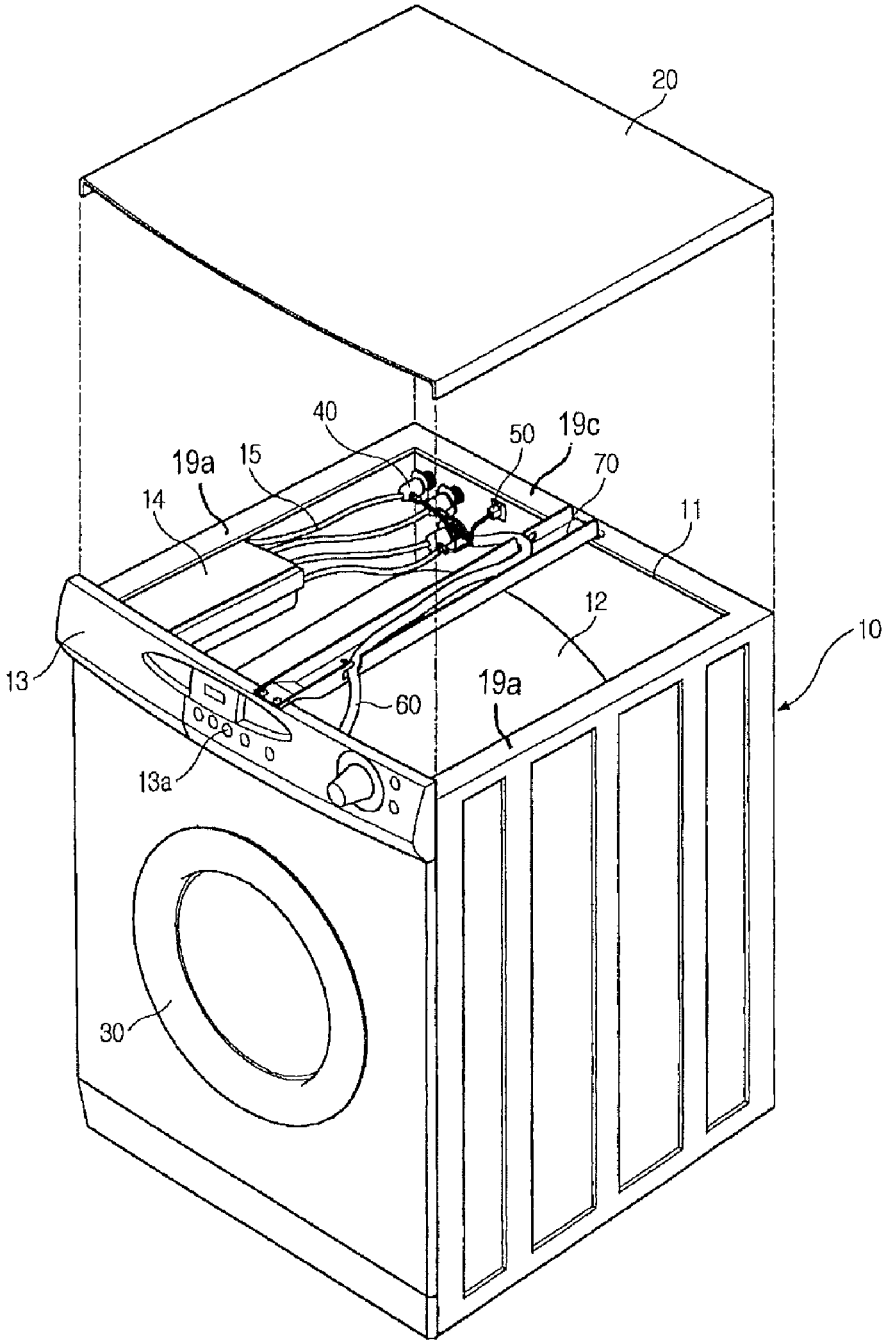
FIG. 1 is a perspective view of a drum washing machine, according to an embodiment of the present invention, with a top plate being separated from a cabinet of the drum washing machine.

Reference will now be made in detail to the embodiments of the present invention, examples of which are illustrated in the accompanying drawings, wherein like reference numerals refer to the like elements throughout. The embodiments are described below to explain the present invention by referring to the figures.

As shown in FIG. 1, a drum washing machine according to the present invention includes a cabinet 10 to define an external appearance of the drum washing machine, with an opening 11 being formed on an upper portion of the cabinet 10. A top plate 20 is mounted to the upper portion of the cabinet 10 to cover the opening 11.

A water tub 12 is set in the cabinet 10 to contain wash water therein. A rotary tub (not shown) is rotatably set in the water tub 12, and is perforated on a sidewall thereof to have a plurality of perforations. Through the plurality of perforations, the wash water flows from the water tub 12 into the rotary tub. Further, a drive motor (not shown) is mounted to a predetermined position of the cabinet 10 to rotate the rotary tub.

A front opening (not shown) is formed on a predetermined portion of a front wall of the cabinet 10 so that a user may put laundry into the rotary tub through the front opening. A door 30 is rotatably mounted to the front wall of the cabinet 10 to open and close the front opening. A control panel 13, having a plurality of buttons 13*a* to control an operation of the drum washing machine, is mounted on the front wall of the cabinet 10 above the front opening.

Further, a plurality of water supply valves 40 are provided on a rear portion of the upper portion of the cabinet 10 to feed the wash water from an external water tap into the water tub 12. Each of the water supply valves 40 is connected, via a connection hose 15, to a detergent container 14 provided on a front portion of the upper portion of the cabinet 10. The wash water, supplied to the detergent container 14 through the connection hoses 15, is fed through a water supply pipe (not shown) into the water tub 12 together with a detergent.

The drum washing machine also includes a water level sensor 50. The water level sensor 50 is provided at a predetermined position around the water supply valves 40 to detect a level of the wash water contained in the water tub 12. In order to connect the water level sensor 50 and the water supply valves 40 to the control panel 13, a plurality of electric wires 60 are provided between the water level sensor 50, the water supply valves 40, and the control panel 13. The plurality of electric wires 60 are tied into an electric cable.

In the drum washing machine constructed as described above, when the buttons 13*a* of the control panel 13 are manipulated, the water supply valves 40 are controlled in response to electric signals transmitted from the control panel 13 through associated electric wires 60 to the water supply valves 40. This allows, a proper amount of water to be fed into the water tub 12, according to an operational mode, such as a washing-mode, a rinsing-mode, and a spin-drying-mode. Thus, a proper level of the wash water contained in the water tub 12 is maintained according to the operational mode.

The drum washing machine is constructed so that the door 30 thereof is mounted to the predetermined portion of the front wall of the cabinet 10. This arrangement is different from a general type of washing machine, which is constructed so that a door is mounted to a top of a cabinet. In the case of the drum washing machine, a household appliance, such as a laundry drying machine, may be placed on a top wall of the cabinet 10. In this case, the top plate 20, mounted to the upper portion of the cabinet 10, may be deformed or broken, due to weight of the household appliance placed thereon.

The drum washing machine, according to the present invention, includes a reinforcement 70. The reinforcement 70 is installed at a predetermined position of the opening 11 of the cabinet 10 to reinforce strength of the top plate 20. As shown in FIG. 1, the cabinet 10 includes horizontally projecting rims, including side horizontally projecting rims 19*a*, front horizontally projecting rim 19*b* (see FIG. 2) and rear horizontally projecting rim 19*c*, provided at the upper portion of the side walls, the front wall and the rear wall, respectively, and the reinforcement 70 extends across the opening 11 of the cabinet.

Figure 2:
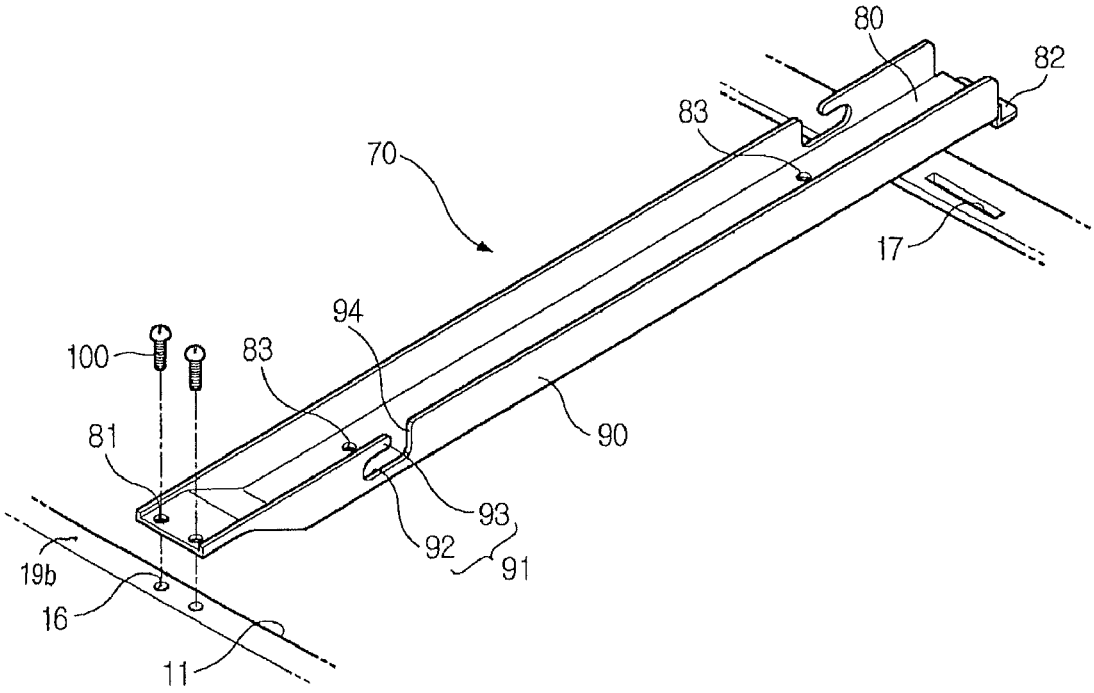
FIG. 2 is a perspective view of a reinforcement included in the drum washing machine of FIG. 1.

As shown in FIG. 2, the reinforcement 70 includes a support plate 80 and right and left side plates 90. The support plate 80 is mounted to a predetermined portion of the cabinet 10, and extends across the opening 11 to couple the front wall to a rear wall of the cabinet 10. The right and left side plates 90 extend upwardly from right and left side edges of the support plate 80, respectively, and integrate with the support plate 80 into a single structure.

In order to fasten the support plate 80 to the front and rear wall of the cabinet 10, first screw holes 81 are provided on a front end of the support plate 80, and second screw holes 16 are provided on an upper end of the front wall of the cabinet 10 at positions corresponding to the first screw holes 81, so that screws 100 are tightened into the first and second screw holes 81 and 16. Further, a locking step 82 is provided at a rear end of the support plate 80, and a locking hole 17 is provided on an upper end of the rear wall of the cabinet 10 at a position corresponding to the locking step 82. Thus, when the locking step 82 of the support plate 80 is inserted into the locking hole 17 provided on the rear wall of the cabinet 10, and the screws 100 are tightened into the first and second screw holes 81 and 16 which are respectively provided on the front end of the support plate 80 and the front wall of the cabinet 10, the support plate 80 is fastened to the cabinet 10 and thereby the reinforcement 70 is installed in the opening 11.

Several options relating to the cooperation of the locking step 82 and the locking hole 17 are available. As shown in FIG. 2, the front 82*a* of the locking step 82 could simply be inserted into the locking hole. Additionally, the locking hole 17 my include a flange (not shown) extending above the locking hole 17 to further secure the front 82*a* of the locking step 82.

In this case, the right and left side plates 90 extend upwardly from the right and left side edges of the support plate 80, to support a lower surface of the top plate 20, and thus reinforce the strength of the top plate 20.

When the reinforcement 70 is installed in the opening 11 of the cabinet 10, the lower surface of the top plate 20 is supported by upper ends of the right and left side plates 90. This arrangement allows the reinforcement 70 to reinforce the strength of the top plate 20. Consequently, when the reinforcement 70 reinforces the strength of the top plate 20, the top plate 20 is not deformed or broken although household appliances, such as laundry drying machines, may be placed on the top plate 20.

An additional advantage of the present invention is provided as follows. When the water tub 12 vibrates by a rotation of the rotary tub during the operation of the washing machine, and the electric wires 60 to couple the water supply valves 40 and the water level sensor 50 to the control panel 13 come into contact with the water tub 12, the electric wires 60 may be damaged or a short circuit may occur.

Therefore, two wire holders 91 are provided on predetermined portions of the reinforcement 70 to hold the electric wires 60. The reinforcement 70 includes the wire holders 91 securing the electric wires 60, in addition to reinforcing the strength of the top plate 20. In a detailed description, each of the wire holders 91 includes an insert groove 92 and a wire stopper 93. The insert groove 92 is provided at a predetermined portion of each of the right and left side plates 90 of the reinforcement 70 so that the electric wires 60 are held in the insert groove 92, with an inlet 94 being formed at an upper portion of the insert groove 92. The wire stopper 93 is provided at an edge of each of the insert grooves 92 adjacent to the inlet 94 to hold the electric wires 60 in the insert groove 92.

One of the wire holders 91 is provided at a front portion of the right side plate 90, while the other wire holder 91 is provided at a rear portion of the left side plate 90. Thus, a part of each of the electric wires 60 between the two wire holders 91, is received in a space defined between the right and left side plates 90.

The electric wires 60 to couple the water supply valves 40 and the water level sensor 50 to the control panel 13, are inserted, at a first predetermined portion of each of the electric wires 60, into the insert groove 91 of the right side plate 90, and at a second predetermined portion of each of the electric wires 60, into the insert groove 91 of the left side plate 90. Further, the part of each of the electric wires 60 passing through the reinforcement 70 between the insert grooves 91 of the right and left side plates 90, is received in the space defined between the right and left side plates 90 of the reinforcement 70.

Each of the wire stoppers 93 is provided at an edge of the inlet 94 of each respective insert groove 92. The wire stoppers 93 are integrated with the associated side plate 90, so that a width of the inlet 94 of the insert groove 92 is less than a width of a remaining part of the insert groove 92. Thus, the electric wires 60 inserted in the insert grooves 92 are stopped by the wire stoppers 93 and are reliably held in the reinforcement 70.

Each of the wire stoppers 93 is provided so that the width of the inlet 94 of each of the insert grooves 92 is larger than a thickness of the electric cable into which the electric wires 60 are tied This arrangement allows the electric wires 60 to be easily set in and removed from each of the insert grooves 92 through each of the inlets 94. This advantage applies at various times during the lifetime of the present invention including when the electric wires 60 are installed in the opening 11 of the cabinet 10, and when the electric wires 60 must be removed from the reinforcement 70 in order to repair the drum washing machine.

Additionally, at least a length of the support plate 80, over which the electric wires 60 are held, is maintained at a greater, depth from the top plate. In other words, an area of the support plate 20, which is between the wire holders 91 at each side plate, provides a bay 90*a* in the reinforcement in which the electric wires may be contained.

According to the present invention, the wire holders 91 are provided on the predetermined portions of the reinforcement 70 which are installed in the opening 11 defined at the upper portion of the cabinet 10 to reinforce the strength of the cabinet 10. Thus, when the reinforcement 70 is installed in the opening 11 of the cabinet 10, the reinforcement 70 reinforces the strength of the top plate 20, and allows a manufacturer to easily hold the electric wires 60 in the cabinet 10. In a detailed description, when the manufacturer passes the electric wires 60 through the wire holders 91 of the reinforcement 70, a process of holding the electric wire 60 in the cabinet 10 is completed. Thereafter, when the top plate 20 covers the opening 11 of the cabinet 10, the reinforcement 70 supports the top plate 20, thus reinforcing the strength of the top plate 20.

Drain holes 83 are formed through predetermined portions of the support plate 80 to smoothly drain water from the reinforcement 70, when water is collected in the reinforcement 70.

The reinforcement 70 allows the electric wires 60 to be easily secured in the cabinet 10, and further reinforces the strength of the top plate 20, thus enhancing reliability of the drum washing machine.

The operation and operational effects of the drum washing machine according to the present invention will be described in the following.

First, the reinforcement 70 is installed in the opening 11 of the cabinet 10. Next, the electric wires 60 are inserted into the insert groove 92 through the inlet 94 of the insert groove 92 of each of the right and left side plates 90. The electric wires 60 are then stopped by each of the wire stoppers 93 and held in each of the insert grooves 92. At this time, the part of each of the electric wires 60 placed between the two wire holders 90 is received in the space between the right and left side plates 90 of the reinforcement 70. The electric wires 60 are thus easily secured in the cabinet 10.

When a user desires to remove the electric wires 60 from the reinforcement 70 in order to repair the drum washing machine, the top plate 20 is first removed from the cabinet 10. Next, the electric wires 60 are moved to the inlets 94 of the insert grooves 92, and are removed from the insert grooves 92. At this time, the electric wires 60 are released from the wire holders 91, and thereby the electric wires 60 are easily removed from the reinforcement 70. When maintenance of the drum washing machine is completed, the electric wires 60 are arranged and secured in the reinforcement 70 through the above-mentioned method.

The reinforcement 70 is installed in the opening 11 of the cabinet 10 to support the top plate 20. Thus, when the top plate 20 is mounted to the upper portion of the cabinet 10 after the reinforcement 70 is installed in the opening 11, the lower surface of the top plate 20 is supported by the upper ends of the side plates 90 of the reinforcement 70. Thus, the strength of the top plate 20 is reinforced by the reinforcement 70.

The drum washing machine according to the present invention is provided with the reinforcement 70, thus allowing the electric wires 60 arranged in the cabinet 10 to be easily secured, to reinforce the strength of the top plate 20, therefore enhancing the reliability of the drum washing machine.

According to the embodiment, the wire holders 91 are respectively provided on the front portion of the right side plate 90 and the rear portion of the left side plate 90. However, when positions of elements, such as the water supply valves 40, the water level sensor 50, and the control panel 13 are changed, positions of the wire holders 91 may be changed. Further, two or more wire holders 91 may be provided on each of the side plates 90 to cope with a variance of length of the electric wires 60.

As is apparent from the above description, the present invention provides a drum washing machine, which is provided with a reinforcement having a wire holder which is provided in an opening defined on an upper portion of a cabinet, thus supporting and reinforcing a top plate mounted to the upper portion of the cabinet.

According to the present invention, the drum washing machine is provided with the reinforcement, thus allowing a plurality of electric wires to be easily arranged and secured in the cabinet, and reinforcing a strength of the top plate, therefore enhancing reliability of the drum washing machine.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A drum washing machine comprising:

a cabinet having a front wall, a rear wall, side walls connecting the front wall and rear wall, and at an upper portion, an upper opening, the cabinet further having a front horizontally projecting rim provided at the upper portion of the front wall and a rear horizontally projecting rim provided at the upper portion of the rear wall;

a water tub installed in the cabinet;

a rotary drum installed in the water tub to receive laundry to be washed, the rotary drum being rotatable with respect to a rotational axis of the rotary drum;

a top plate being supported at edges thereof by the front and rear walls, and the side walls to cover the opening;

a reinforcement beam coupled to the front horizontally projecting rim provided at the upper portion of the front wall at one end thereof and coupled to the rear horizontally projecting rim provided at the upper portion of the rear wall at the other end such that the reinforcement beam extends across the upper opening of the cabinet and is parallel to the rotational axis of the rotary drum;

a control panel having a plurality of user control buttons to control an operation of the drum washing machine, mounted to an upper front portion of the cabinet; and an electric wire disposed on a top surface of the reinforcement beam, the electric wire extending from the control panel toward a rear of the cabinet, wherein the reinforcement beam and the top plate are installed to the cabinet separately with respect to each other.

2. The drum washing machine of claim 1, wherein the cabinet further comprises a first side rim projecting horizontally from the upper portion of one of the side walls, wherein a detergent container is provided on a front portion of the upper portion of the cabinet between the reinforcement beam and the first side rim such that the detergent container is positioned immediately adjacent to the first side rim and the front horizontally projecting rim.

3. The drum washing machine of claim 1, wherein the front horizontally projecting rim is provided with a plurality of screw holes positioned to match with the screw holes of the reinforcement beam.

4. The drum washing machine of claim 1, wherein the reinforcement beam includes a front bent portion and a rear bent portion provided at a front portion and a rear portion thereof so as to provide additional structural strength in the longitudinal direction thereof.

5. The drum washing machine of claim 1, further comprising a plurality of wire holders provided at the reinforcement beam to hold the electric wire extending from the control panel such that the electric wire is maintained on the top surface of the reinforcement beam.

6. The drum washing machine of claim 5, wherein the wire holders are integrally formed with the reinforcement beam.

7. The drum washing machine of claim 1, wherein the reinforcement beam extends across a midsection of the upper opening of the cabinet.

8. The drum washing machine of claim 1, wherein the reinforcement beam includes at least one screw hole, the reinforcement beam is removably fastened to the front horizontally projecting rim by tightening at least one screw into the at least one screw hole.

9. The drum washing machine of the claim 1, wherein the electric wire supported by the top surface of the reinforcement beam extends across a top of the washing machine without physically contacting a bottom surface of the top plate.

10. A drum washing machine comprising:

a cabinet having a front wall, a rear wall, side walls connecting the front wall and rear wall, a front horizontally projecting rim provided at an upper portion of the front wall and a rear horizontally projecting rim provided at an upper portion of the rear wall;

a water tub installed in the cabinet;

a rotary drum installed in the water tub to receive laundry to be washed, the rotary drum being rotatable with respect to a rotational axis of the rotary drum;

a top plate being supported at edges thereof by an upper portion of the cabinet to cover an upper opening of the cabinet;

a reinforcement beam coupled to the front horizontally projecting rim at one end thereof and coupled to the rear horizontally projecting rim at the other end thereof such that the reinforcement beam extends across the upper opening of the cabinet and is parallel to the rotational axis of the rotary drum;

a control panel having a plurality of user control buttons to control an operation of the drum washing machine, mounted to an upper front portion of the cabinet; and an electric wire disposed on a top surface of the reinforcement beam, the electric wire extending from the control panel toward a rear of the cabinet, wherein a plurality of wire holders are provided at the reinforcement beam to hold the electric wire extending from the control panel such that the electric wire is maintained on the top surface of the reinforcement beam.

11. The drum washing machine of claim 10, wherein the wire holders are formed integral with the reinforcement beam.

12. The drum washing machine of claim 10, wherein the cabinet further comprises a first side rim projecting horizontally from the upper portion of one of the side walls, wherein a detergent container is provided on a front portion of the upper portion of the cabinet between the reinforcement beam and the first side rim such that the detergent container is positioned immediately adjacent to the first side rim and the front horizontally projecting rim.

13. The drum washing machine of claim 10, wherein the reinforcement beam and the top plate are installed to the cabinet separately and independently with respect to each other.

14. The drum washing machine of claim 10, wherein the reinforcement beam includes a front bent portion and a rear bent portion provided at a front portion and a rear portion thereof so as to provide additional structural strength in the longitudinal direction thereof.

15. The drum washing machine of the claim 10, wherein the electric wire supported by the top surface of the reinforcement beam extends across a top of the washing machine without physically contacting a bottom surface of the top plate.

16. The drum washing machine of claim 10, wherein the reinforcement beam extends across a midsection of the upper opening of the cabinet.

17. A drum washing machine comprising:

a cabinet having a front wall, a rear wall, side walls connecting the front wall and rear wall, a front horizontally projecting rim provided at an upper portion of the front wall and a rear horizontally projecting rim provided at an upper portion of the rear wall;

a water tub installed in the cabinet;

a rotary drum installed in the water tub to receive laundry to be washed, the rotary drum being rotatable with respect to a rotational axis of the rotary drum;

a top plate being supported at edges thereof by an upper portion of the cabinet to cover an upper opening of the cabinet;

a reinforcement beam coupled to the front horizontally projecting rim at one end thereof and coupled to the rear horizontally projecting rim at the other end thereof such that the reinforcement beam is parallel to the rotational axis of the rotary drum; and a control panel having a plurality of user control buttons to control an operation of the drum washing machine, mounted to an upper front portion of the cabinet, wherein a top surface of the reinforcement beam is used to route an electric wire extending from the control panel toward a rear of the cabinet, the reinforcement beam includes a front bent portion and a rear bent portion provided at a front portion and a rear portion thereof so as to provide additional structural strength in the longitudinal direction thereof.

18. The drum washing machine of claim 17, wherein a plurality of wire holders are provided at the reinforcement beam to hold the electric wire extending from the control panel such that the electric wire is maintained on the top surface of the reinforcement beam.

19. The drum washing machine of claim 18, wherein the wire holders are formed integral with the reinforcement beam.

20. The drum washing machine of claim 17, wherein the reinforcement beam and the top plate are installed to the cabinet separately and independently with respect to each other.

21. The drum washing machine of claim 17, wherein the cabinet further comprises a first side rim projecting horizontally from the upper portion of one of the side walls, wherein a detergent container is provided on a front portion of the upper portion of the cabinet between the reinforcement beam and the first side rim such that the detergent container is positioned immediately adjacent to the first side rim and the front horizontally projecting rim.

* * * * *

UNITED STATES PATENT AND TRADEMARK OFFICE

CERTIFICATE OF CORRECTION

PATENT NO. : 8,261,580 B2
APPLICATION NO. : 12/662912
DATED : September 11, 2012
INVENTOR(S) : Jae Myong Kim et al.

It is certified that error appears in the above-identified patent and that said Letters Patent is hereby corrected as shown below:

Column 8, Line 25, In Claim 9, delete "of the claim" and insert -- of claim --, therefor.
Column 9, Line 14, In Claim 15, delete "of the claim" and insert -- of claim --, therefor.

Signed and Sealed this
Twentieth Day of November, 2012

David J. Kappos

David J. Kappos
*Director of the United States Patent and Trademark Office*